United States Patent [19]

Andréasson

[11] 4,231,435

[45] Nov. 4, 1980

[54] TOOL FOR USE PRIMARILY IN CONJUNCTION WITH A ROCKBREAKER UNIT

[76] Inventor: Lars I. Andréasson, Söderdalsgatan 48, 502 54 Borås, Sweden

[21] Appl. No.: 907,462

[22] Filed: May 19, 1978

[30] Foreign Application Priority Data

May 27, 1977 [SE] Sweden ..... 7706280

[51] Int. Cl.[2] ..... B23B 31/00; B23B 5/22

[52] U.S. Cl. ..... 173/128; 279/19

[58] Field of Search ..... 173/128–133; 175/19, 22, 23; 279/19–19.7

[56] References Cited

U.S. PATENT DOCUMENTS

| | | | |
|---|---|---|---|
| 1,213,970 | 1/1917 | Sturtevant | 279/19 X |
| 1,220,100 | 3/1917 | Haeseler | 173/133 |
| 1,262,960 | 4/1918 | Lea | 279/19 |
| 1,605,435 | 11/1926 | Hansen | 173/133 X |
| 1,847,135 | 3/1932 | Oldham | 173/130 |
| 2,055,898 | 9/1936 | Huffman | 279/19 |
| 2,356,314 | 8/1944 | Gray et al. | 173/133 X |
| 2,903,932 | 9/1959 | McGonagill | 173/131 X |
| 3,327,516 | 6/1967 | Anderson | 173/131 X |
| 3,425,498 | 2/1969 | Bick | 173/133 X |

*Primary Examiner*—Lawrence J. Staab

*Attorney, Agent, or Firm*—Sughrue, Rothwell, Mion, Zinn and Macpeak

[57] ABSTRACT

A tool intended for use in conjunction with carrier machinery, primarily a rockbreaker, comprising two axially aligned elongated members, one of which may be introduced into the carrier machinery with one end and into a recess in the other (second) member with its other end. A third member surrounds the second member and is suspended by the carrier machinery. When the carrier machinery is in operation it impacts the engaging end of the first member, thereby impacting the second member, which may operate as a plunger for producing holes in the ground. The second member is driven into the ground in consequence of a series of short impacts of the carrier machinery on the first member. The second member is provided with means for engagement by the third member to enable the second member to be pulled out of the ground when the hole has the required depth.

4 Claims, 6 Drawing Figures

TOOL FOR USE PRIMARILY IN CONJUNCTION WITH A ROCKBREAKER UNIT

BACKGROUND OF THE INVENTION

1. Field of the Invention

This invention refers to a tool which is intended for use primarily in conjunction with a rockbreaker or with an impact hammer, preferably a hydraulic rockbreaker which may be mounted on carrier machinery, for example a digging machine.

2. Description of the Prior Art

Rockbreakers utilizing one-piece chisels are used for rupturing and breaking up rock, concrete, etc. into smaller pieces. Also, rockbreakers with one-piece crowbars have been used for producing holes in the ground in preparation for positioning various types of poles (for example telephone poles and poles for electric power lines), fences, guard rails, etc. therein.

However, these chisels and crowbars have the disadvantage that their effective lives are very short so that they have to be replaced at short intervals, which is not only expensive but also frustrating.

SUMMARY OF THE INVENTION

The tool of the invention comprises a plurality of portions, i.e. a supporting portion and an engagement portion, both of which may take various forms. For example, it may comprise a subdivided crowbar for producing holes in the ground in preparation for positioning various types of poles therein as mentioned above. Alternatively the engagement portion may take the shape of a chisel or a splitting member. Such chisel may for instance be utilized for cracking frozen earth. In the latter case the chisel should preferably be clamped in a predetermined position in the supporting portion so that it will not rotate. A splitting member may be utilized for splitting heavy logs and for chopping up stumps. Another use of the tool of the invention is for driving piles and beams into the ground. In this case it is necessary first to make holes in the ground by means of the tool and then to replace the lower portion of the tool (its engagement portion) by a carrier for the relevant pile or beam which thereafter is driven down to the desired depth in the ground. On the basis of the concept of the invention it is possible to obtain a complete system of different tools for different purposes, wherein one and the same upper portion may be utilized in conjunction with a plurality of different lower portions, whereby not only considerable savings in cost may be achieved as the result of it being possible to combine one upper portion with a plurality of different lower portions, but also it becomes possible to economize by replacing one single portion if breakage occurs. Most importantly, however, the structure in accordance with the invention makes it possible to achieve a service life of the tool and a speed in operation which are considerably greater than ever before.

Although the tool of the invention substantially will be described as a composite crowbar primarily being intended to be utilized in conjunction with a hydraulic rockbreaker which may be mounted on carrier machinery, for example a digging machine, it is pointed out that the tool is not restricted to this use.

In order to make it possible to mount for example piles and poles associated with factory fences, animal protection fences along trafficways, guard rails, and hub rails in the ground it is necessary to make holes in the ground, regardless of the composition of the earth material.

Producing holes in the ground by means of a crowbar places very high requirements on the design of the crowbar if the holes are to be produced mechanically, for example by means of carrier machinery. Thus, in practice it turns out that the material of a conventional crowbar will not be able to stand up against welding joints or cavities, and if such exist, then the crowbar will rupture as the result of the very high impact energy that is developed in efforts to drive the crowbar down into the ground.

It is an object of this invention to provide a crowbar having superior properties in this respect. Said crowbar may for example have a diameter of between 150 millimeters and 200 millimeters and greater and a minimum length of 1000 millimeters, and nevertheless it will stand up to impact driving into all existing kinds of earth material, except solid rock, with high capacity and at comparatively low cost.

A tool in accordance with the invention taking the form of a crowbar may to advantage be mounted as a tool for providing holes in the ground in a hydraulic rockbreaker of a type known per se and being intended for mounting on a digging machine. Rockbreakers of the relevant type have been introduced on the market to enable rock material, concrete, etc., to be ruptured and broken up into smaller pieces by means of simpler types of chisels. In tests it has proved to be possible to achieve by means of a tool in accordance with the invention being embodied as a crowbar—when producing holes for fences having the dimensions 165 millimeters by 900 millimeters in a material consisting of broken rock—a capacity of approximately 200 holes per eight hour shift, which people skilled in the art indicate is quite incredible.

Among the advantages that may be achieved by means of a tool in accordance with the invention it may be mentioned that both the length and the width of said tool may be varied, whereby in the case when the tool is embodied as a crowbar holes of appropriate sizes for different poles may be attained. Furthermore, as the tool is subdivided, its upper portion may be utilized in conjunction with lower portions having various dimensions and shapes so that they may be used for different purposes. With the tool taking the shape of a crowbar it is possible to achieve high effectivity in making holes, as the portion of the tool penetrating the earth is lighter than a conventional crowbar but nevertheless will have the same impact energy as a conventional crowbar. The hole-making effectivity can be varied by varying the amount, and hence the weight, of the material in the lower portion of the tool by providing a larger or smaller recess for the upper portion of the tool in the lower portion of the tool. Finally the strain on both the upper portion of the tool and the lower portion of the tool is substantially smaller than the total strain in a conventional crowbar. In practice it turns out that the upper portion of the tool is the portion which is subjected to breakage first, and in consequence of the design of the tool it is relatively simple to replace said portion. This can be done at reasonable cost, which should be compared to the conventional case when the complete crowbar has to be replaced.

When the tool in accordance with the invention is embodied as a crowbar, its lower portion, which is to engage an upper portion, which for example is supported by a hydraulic rockbreaker, may be provided with a cylindrical recess in its upper portion, into which recess a cylindrical, lower section of the upper portion of the tool may be introduced, whereas if the tool is embodied for instance as a chisel for splitting or the like, it may be appropriate to provide the recess in said lower portion, or at least part of said recess, with a square cross section and to design the lower section of the upper portion of the tool in corresponding manner so that the lower portion of the tool may be reset 90° or a multiple thereof as desired, with said lower portion being controlled by the upper portion.

The primary object of the invention is to provide a tool of the type mentioned by way of introduction, and the means by which the desired object may be achieved are defined in the accompanying claims.

BRIEF DESCRIPTION OF THE DRAWINGS

The invention will be described more specifically below with reference to the accompanying drawings, which show examples of embodiments of the invention, wherein.

DESCRIPTION OF THE PREFERRED EMBODIMENTS

The tool designed in accordance with the invention comprises three portions, namely a first, upper portion which is intended to be disposed for example in a hydraulic rockbreaker which may be mounted on carrier machinery, for example a digging machine, furthermore a second portion which is provided with a recess, into which a section of said first portion may extend, and finally an annular member which is suspended by the rockbreaker and which is slidable along the exterior of said second portion and is engageable by said second portion by means of a barrier disposed on said second portion, for instance an abutment.

Figure 1:
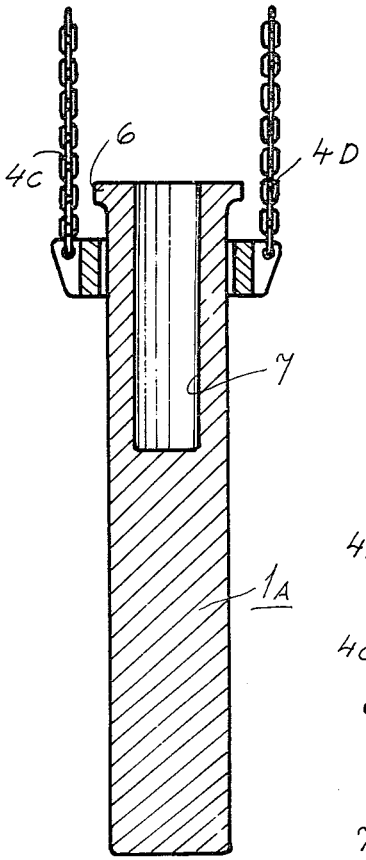
FIG. 1 shows a longitudinal sectional view of the lower portion or ground hole portion 1A of a crowbar, FIG. 1' shows said ground hole portion viewed from above.
Figure 1:
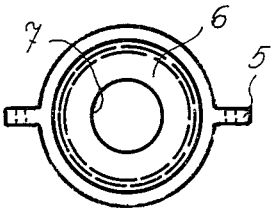
Figure 2:
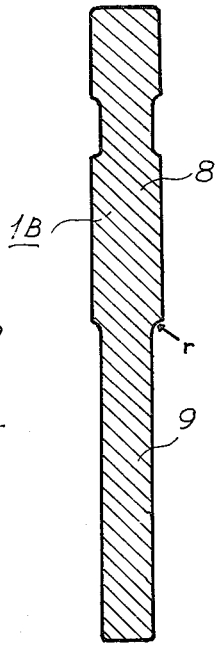
FIG. 2 illustrates an example of the upper portion or mandrel portion 1B of the crowbar.

FIG. 1 shows said lower portion or engagement portion embodied as a ground hole portion 1A forming a portion of a crowbar, the mandrel portion 1B of which is illustrated in FIG. 2. Both the ground hole portion and the mandrel portion may be made of for example iron, and a recess, for example an opening 7 made by means of a lathe, may be provided in the upper part of the ground hole portion 1A, into which opening the lower part 9 of said mandrel portion 1B is intended to be introduced so as to fit in the manner disclosed by FIG. 3. In the embodiment illustrated in FIG. 3 the upper part 8 of the mandrel portion is designed such, that it may be mounted and affixed in a sheath which is included in the casing of for example a hydraulic rockbreaker 3 which is available on the market for being mounted on a digging machine. In the illustrated case the mandrel portion is secured by means of projections in the interior of the rockbreaker sheath, said projections mating with recesses 2 in the upper part 8 of the mandrel portion so that the mandrel portion will not be rotatable in the rockbreaker. However, the manner in which the mandrel portion is disposed in the rockbreaker may be adapted to any suitable rockbreaker sheath. Alternatively, it may be desirable to have the mandrel portion rotatable in the rockbreaker. This can be achieved by said upper part being designed in accordance with 8' of FIG. 4, i.e. lacking recesses corresponding to the recesses 2 of FIG. 3. The upper part 8' of the mandrel portion will then be retained in the rockbreaker by means of said second portion of the tool as will be disclosed in the following.

Figure 3:
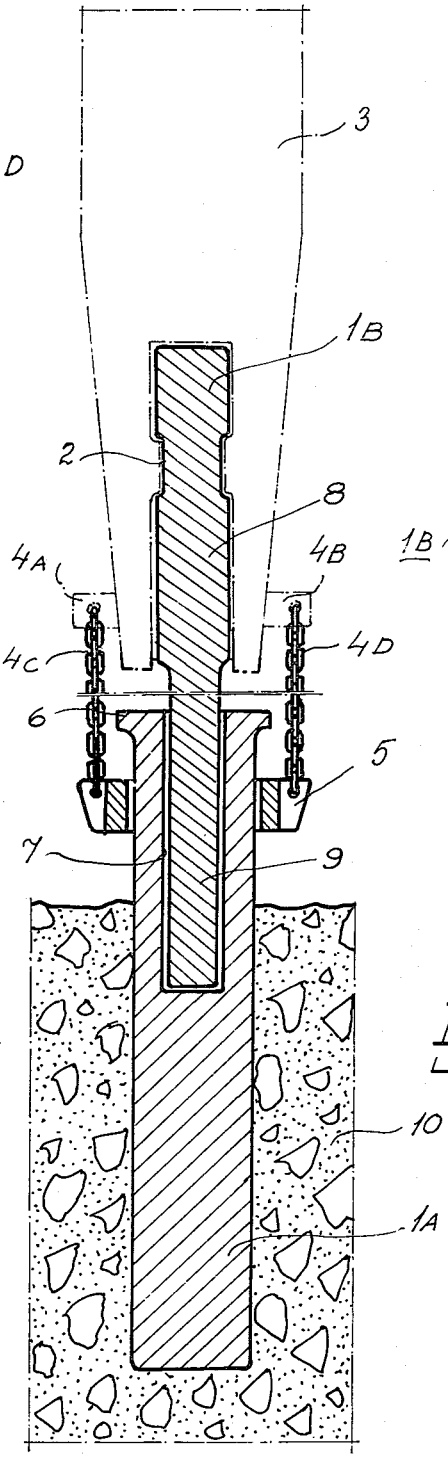
FIG. 3 shows a sectional view of a complete crowbar with the portions 1A and 1B introduced into each other at one end and with the opposite end of the portion 1A illustrated driven down into the ground, whereas the opposite end of the portion 1B is introduced into a rockbreaker associated with a digging machine (not shown)

In the embodiment illustrated in FIG. 3 the rockbreaker casing is provided with projections 4A and 4B suspending chains 4C and 4D, respectively, which at their lower ends carry a ring 5. This ring 5 serves as a guide for the ground hole portion or engagement portion 1A when the latter is driven down into the ground. Also, the ring 5 is used to pull the ground hole portion up out of the ground subsequently to a hole being produced. Additionally, the ring 5 in cooperation with the ground hole portion retains the mandrel portion in the rockbreaker when the mandrel portion is designed in accordance with FIG. 4.

Figure 4:
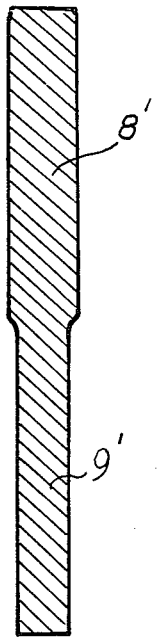
FIG. 4 shows another longitudinal sectional view of the mandrel portion corresponding to FIG. 2, wherein, however, the mandrel portion of FIG. 4 may rotate freely when it is positioned in a rockbreaker in contrast to the mandrel portion of FIG. 2.

In FIGS. 2 and 4, respectively, which show the mandrel portion alone, it may be seen that its upper parts 8 and 8', respectively, have larger diameters than the respective lower parts 9 and 9'. The transition between the sections having these diameters begins slightly above the lower end of the rockbreaker sheath when the respective upper parts 8 and 8' of the mandrel portion are disposed in the rockbreaker in the manner illustrated by FIG. 3. The reason for this is that it has been found that it becomes possible to avoid a beginning fracture at the location where the mandrel portion exists from the rockbreaker sheath as the result of this design.

In practice it is found that the ground hole portion 1A has a tendency to rotate when it is being driven down into the ground, and the thought occurs that there might be a danger of the retaining chains 4C and 4D, respectively, in which the ring 5 is suspended, snapping off if they were to follow along in the rotative movement by the ring 5 also being rotated. However, said ring is loosely disposed around the ground hole portion and thus the ring does not have to follow along in the rotative movement, whereby the above-mentioned danger is obviated.

With regard to the recess, i.e. the opening 7, in the ground hole portion, which opening for example may be made by turning in a lathe or by molding, it may be mentioned that as said recess enables guidance of the crowbar, said recess is a contributing factor to making it possible to construct the crowbar in two portions, whereby its life is increased to a great extent, as the strains that occur in each one of the portions of the crowbar in accordance with the invention will become substantially smaller than the strains that would occur if the crowbar were made in one single piece.

As a modification the abutment 6 may have substantially greater height than illustrated, and the portion of the ring 5 engaging the abutment 6 may be provided with a recess so that the abutment 6 may slide down into the ring 5 to some extent. In this manner it becomes possible to achieve the valuable advantage that the stroke can be increased additionally.

Figure 5:
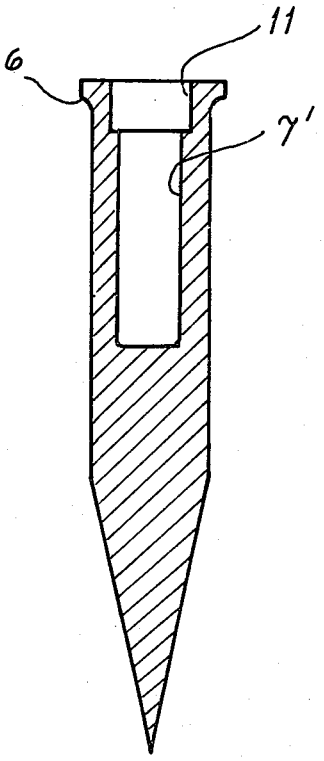
FIG. 5 shows a longitudinal sectional view through a chisel embodied as the lower portion of the tool of the invention provided with a recess, the upper part of which is of square cross section, whereby it becomes possible to set the chisel to a predetermined rotational position on the condition that the upper portion of the tool is designed in such manner that it engages said lower portion correctly.
Figure 6:
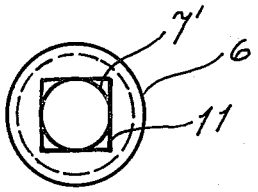
FIG. 6 shows a plan view of the chisel portion of FIG. 5, wherein the upper square cross section and the lower circular cross section of the recess may be seen.

FIGS. 5 and 6 illustrate a chisel which is intended to be utilized in the tool of the invention and which is designed with its upper, internal portion 11 being of square cross section. By cooperation between this square cross section and a mating portion of the lower part 9 and 9', respectively, of the upper portion of the tool it becomes possible to set the downwardly located (screwdrivertip-like) tip of the chisel in positions lying at 90° with respect to each other. A chisel of this type may advantageously be utilized for example for splitting logs. The inward part 7' of the chisel located below the portion 11 may be cylindrical as in the embodiment described above.

In tools for producing holes in the ground of the above-described types it is of course possible to achieve different depths and diameters of the ground holes by operating with different ground hole portions 1A having individual lengths and diameters. As has been mentioned by way of introduction various such ground hole portions may cooperate with one and the same mandrel portion, which naturally is favorable from the point of view of costs as well as of handling.

As an additional modification it is possible to utilize a protective tube (not illustrated) which is disposed around the ground hole portion in the form of a sheath. This design may be of good use when holes are to be made in soft ground and there is a danger that the walls surrounding the hole may cave in. In this utilization said protective tube is caused to accompany the ground hole portion down into the ground by the upper edge of the protective tube being driven down by the lower edge of the ring 5. When the ground hole portion is raised out of the hole by means of the ring 5 engaging the abutment 6 the protective tube remains in the ground and prevents the soft surrounding earth from sliding down into the hole.

As indicated above, each of the portions 1A and 1B included in the crowbar described above may be dimensioned in a variety of manners, whereby it becomes possible to achieve different depths and different diameters, respectively, of the hole produced in the ground. Furthermore, a gap of approximately 2 millimeters, counted along the diameter, may exist between the lower part 9 of the mandrel portion 1B and the recess 7 in the ground hole portion 1A, into which gap seepage oil from the rockbreaker may flow so as to carry out both lubrication and cooling.

Alternatively to the ground hole portion that has been described above other lower portions may be utilized, as has been indicated, for example bars or rods for cracking frozen ground (in connection with construction work), asphalt chisels, and adapters for driving down piles and poles, etc., wherein these lower portions are made to cooperate with the upper portion of the tool as described above.

Although the ground hole portion of the illustrated examples is shown as being solid and flat and chisel-shaped, respectively, at its lower end, it may of course be for instance concave or convex at said lower end or for example shaped in appropriate manner for engaging piles.

Thus, the invention is not limited to the embodiments illustrated in the drawings and to those described above. These embodiments solely comprise examples of the invention and are intended to illustrate the manner in which it is utilized.

What is claimed is:

1. A tool for use in connection with a rockbreaker unit comprising (a) a first substantially elongate member, (b) a second substantially elongate member, said second substantially elongate member having a central recess at one end and an external abutment at the same end, and (c) a third member, said third member being a body having an aperture mating with the external circumference of said second substantially elongate member, said first substantially elongate member being carried by said rockbreaker unit in such manner as to project partially out of said unit for extending into said recess in said second substantially elongate member with its projecting portion, and said third member being suspended by chains secured to said rockbreaker unit and surrounding said second substantially elongate member, said third member being slidable along the exterior of said second substantially elongate member for engaging said external abutment thereof in consequence of said chains being drawn taut by relative displacement of said rockbreaker unit with regard to said second substantially elongate member.

2. A tool in accordance with claim 1, wherein said first substantially elongate member comprises a substantially cylindrical rod having two diameters, between which a rounded transition is disposed approximately at the location where the first substantially elongate member exits from the rockbreaker unit.

3. A tool in accordance with claim 1, wherein said first substantially elongate member is rotatable in said rockbreaker unit and said second substantially elongate member comprises an elongate cylindrical member for producing holes in the ground.

4. A tool in accordance with claim 1, wherein said second substantially elongate member consists of a splitting member being formed as a chisel at its free end and said recess in said second substantially elongate member has a substantially square internal cross section mating with a substantially square cross section in said partially projecting portion of said first substantially elongate member.

* * * * *